US005280918A

United States Patent [19]

Wu

[11] Patent Number: 5,280,918

[45] Date of Patent: Jan. 25, 1994

[54] BEACON TARGET

[76] Inventor: Jenn-Jia Wu, 12th Fl., No. 136, Sec. 2, Chilung Rd., Taipei, Taiwan

[21] Appl. No.: 35,265

[22] Filed: Mar. 22, 1993

[51] Int. Cl.[5] ..... F41J 5/04

[52] U.S. Cl. ..... 273/374; 273/371; 273/363

[58] Field of Search ..... 273/363, 371, 375, 380, 273/374

[56] References Cited

U.S. PATENT DOCUMENTS

| | | | |
|---|---|---|---|
| 727,419 | 5/1903 | Nelson | 273/363 |
| 4,243,228 | 1/1981 | Marcella | 273/363 |
| 4,498,677 | 2/1985 | Dapkus | 273/380 |
| 4,695,059 | 9/1987 | Yamashita et al. | 273/380 |

*Primary Examiner*—Benjamin H. Layno

*Attorney, Agent, or Firm*—Morton J. Rosenberg; David I. Klein

[57] ABSTRACT

A beacon target comprises an ignition device and a gas supply device received in a case body, and a movable target mounted outside the case body. The front portion of the case body is separated as a gas chamber and its leading end having a transparent panel for displaying gas explosion effect within the gas chamber. The rear portion of the case body is a room for receiving each of said devices. When the movable target is hit by a bullet, the bottom end of the target will press down both micromotion switches and simultaneously actuate the ignition device and gas supply device. The gas chamber at the leading end of the case body is filled with fuel gas which is triggered by the ignition device to accomplish intensive sound and lighting effect of explosion at a twinkling eye and a kind of beacon target with shaking result is accomplished thereof.

1 Claim, 3 Drawing Sheets

BEACON TARGET

BACKGROUND OF THE INVENTION

The present invention relates to a beacon target and more particularly to a specially designed beacon target having audible and visual effects of an explosion.

Shooting games have become more and more popular not only because it promotes physical exercise but because of the fun and satisfaction players get from shooting at a target, which is not found in any other recreational sports.

Conventional shooting targets lack realistic sound and lighting effects, thus making the occurrence of a bullet or projectile hitting a target uneventful. Moreover various conventional shooting targets are either simple in their construction without attractiveness or so complicated in their construction as to become expensive and not suitable to meet the need of shooting games.

A shooting game device having an explosion effect and absolute having safety is never seen on prevailing market. Thus, if a device is designed with absolutely safety and fully displaying intensive sound and lighting effects of an explosion, it should make shooting games more attractive and amusing.

SUMMARY OF THE INVENTION

In order to improve the defects of various conventional devices as above mentioned, the present invention has been accomplished under the circumstances in view. It is an object of the present invention to provide a target which can produce an explosion effect from being hit by toy bullets (such as BB bullet or the like) while preventing even a sheet of toilet tissue from being burned from within a radius of explosion range. More specifically it is absolutely safe but effective to create a shaking effect.

Another object of the present invention is to provide a beacon target of simple construction and low production cost which simulates an explosion effect created by a real gun and bullet, and is suitable for both the aged and the youth and is applicable to soliders' target-shooting practice.

These and other objects and advantages of the present invention will become apparent to those skilled in the art after considering the following detailed specification together with the accompanying drawings.

DETAILED DESCRIPTION OF THE INVENTION

Figure 1:
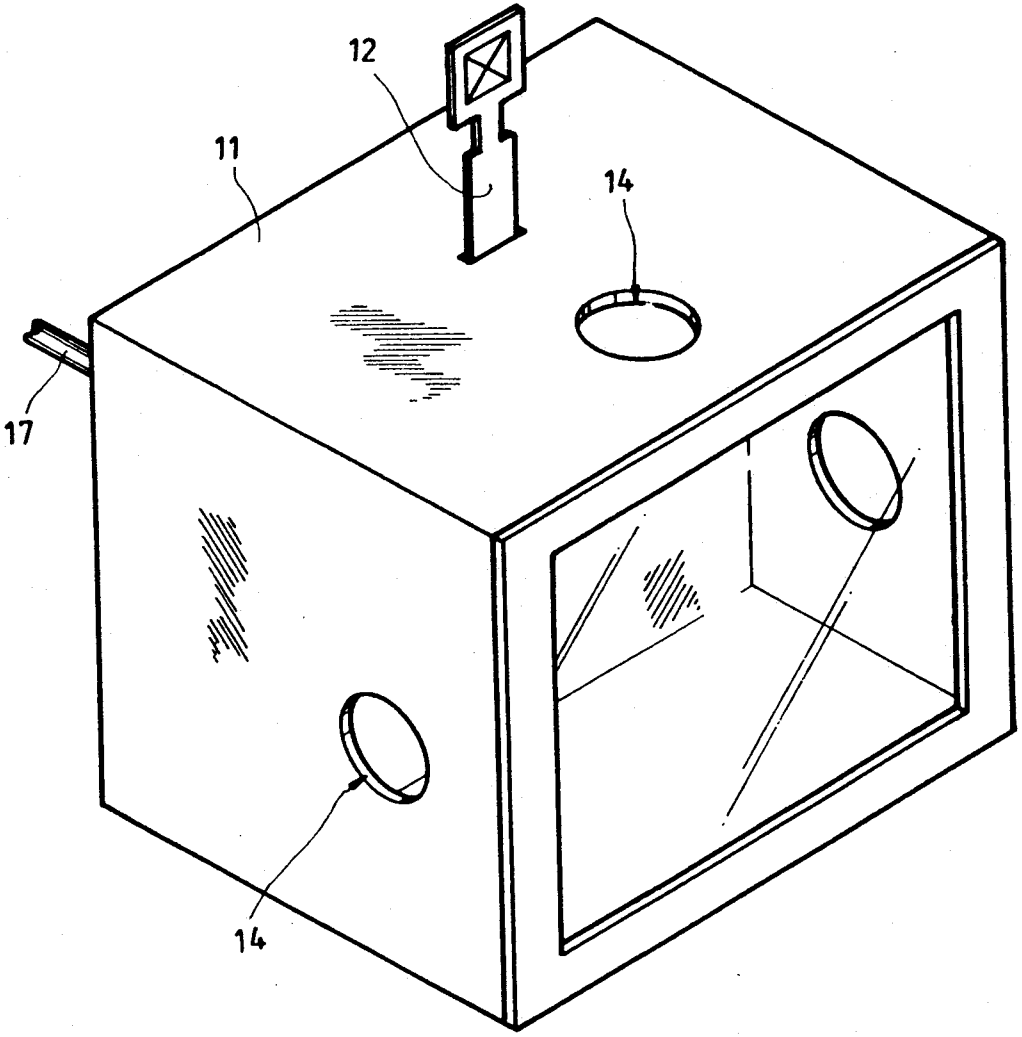
FIG. 1 is an elevational perspective view of the present invention.
Figure 2:
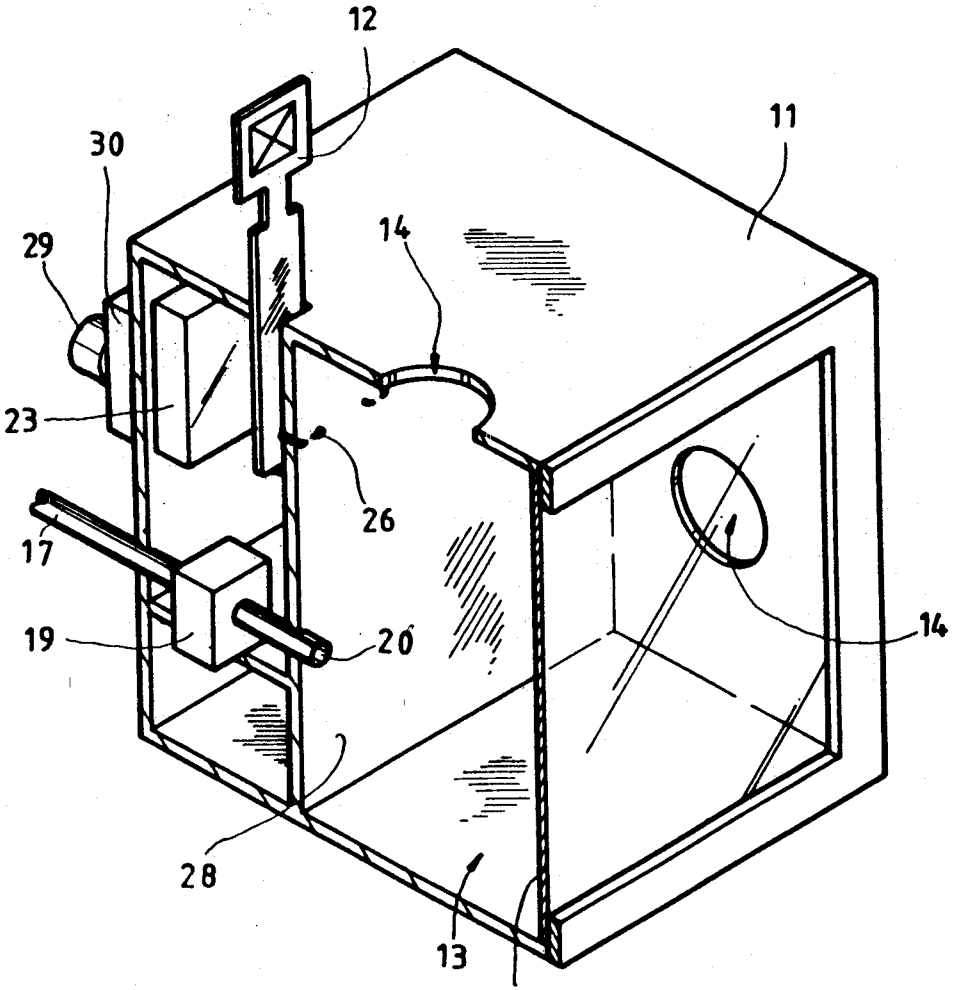
FIG. 2 is a cutaway elevational view of the present invention.
Figure 3:
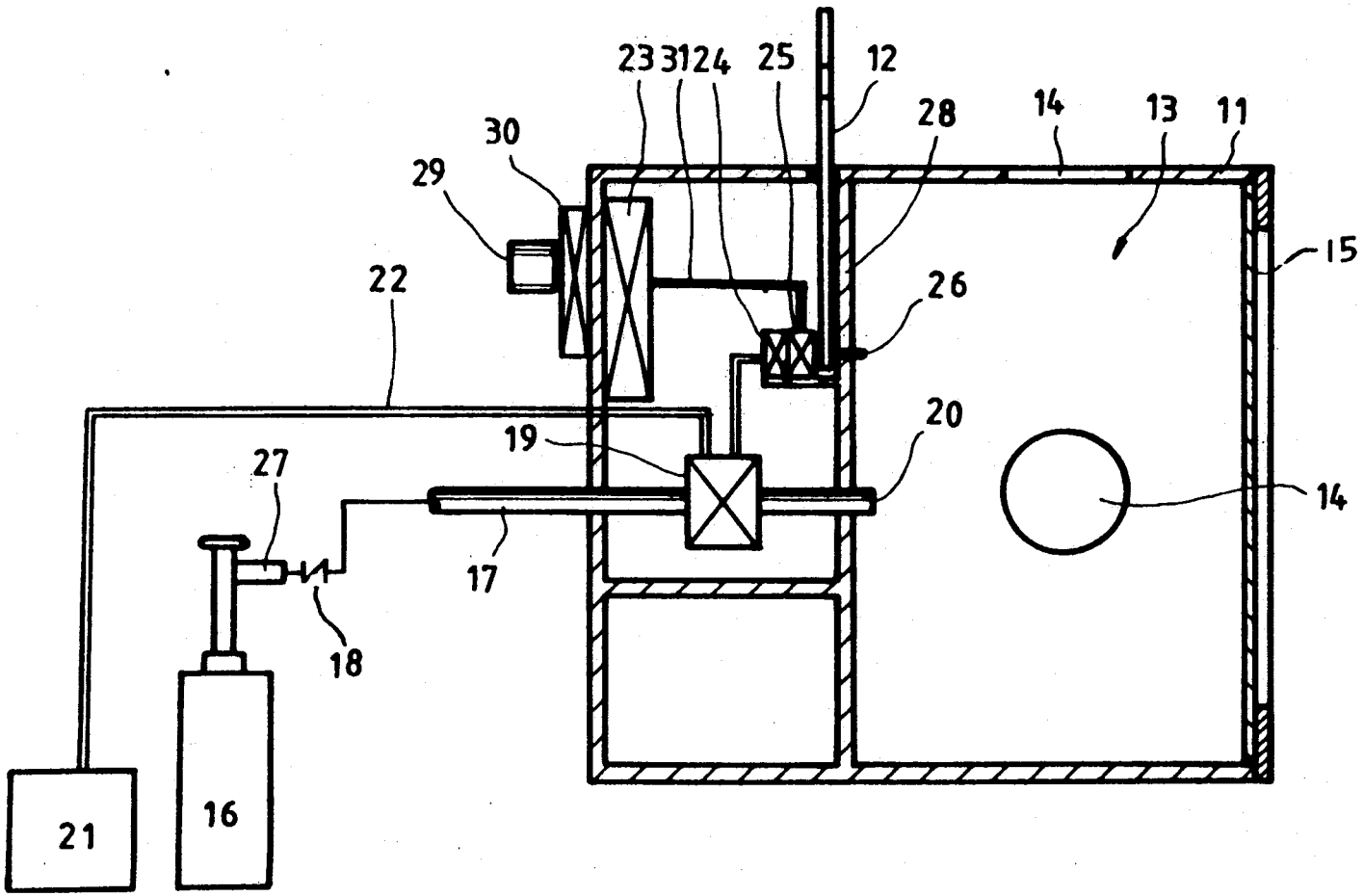
FIG. 3 is a side elevational view in cross section of the present invention and the connection of fuel bottle and battery.

Referring to the drawings, the present beacon target includes an ignition device and air supply device received in a case body 11, and a movable target 12.

The case body 11 includes a first half portion which is separated as an gas chamber 13 wherein the left and right ends of the gas chamber 13 as well as the upper wall of the case body 11 have an air intake hole 14 to permit air entry therefrom for mixing with fuel gas and causing flames to jet out of the case body at the moment of gas explosion. The leading end of the case body 11 has a transparent panel 15 for displaying gas explosion effect within the gas chamber 13. And the rear half portion of the case body 11 is a room for receiving each of said devices therein.

The air supply device includes a fuel bottle 16 which is in communication with a solenoid valve 19 received in the case body 11 by virtue of a conduit 17 in connection with a pressure switch 18, and an air outlet end 20 having a check valve is extending through the baffle plate 28 between the case body into the gas chamber 13. The fuel bottle 16 is filled in non-oxygen fuel gas. When the solenoid valve 19 is powered up it may control the amount of fuel gas supplied from the fuel bottle 16 into the gas chamber or the supply of fuel gas is synchronously cut off together with the power supply cut-off for the solenoid valve 19.

The ignition device includes a battery 21, which is connected to a micromotion switch 24 within the case body 11 by virtue of a cord 22 and then in connection with the solenoid switch 19. When the micromotion switch 24 is triggered, it will cause the solenoid valve 19 to power up the conduit 17 for feeding gas into the gas chamber 13. Another high-voltage power supply includes a battery set 30 mounted on the rear wall of the case body and controlled by a switch valve 29, which is connected to a transformer 23 in the case by virtue of a cord 31 through a micromotion switch 25 and the output end of the transformer 23 is in connection with a plurality of ignition copper wires 26 mounted on the baffle plate of the case body. When the micromotion switch 25 is triggered, it will power up the high-voltage power ignition copper wires 26 and high-voltage sparks are produced at the points of a plurality of ignition copper wires 26 for sparkling fuel gas within the gas chamber.

The movable target 12 resembles a long plate shape and its top end has a target plane and its bottom end is inserted in the case body 11 and located right beside the two micromotion switches 24, 25. Thus, when the target plane at the upper end of the movable target 12 is hit by a bullet, the bottom end of the target will press down the two micromotion switches 24, 25 and simultaneously actuate the ignition device and gas supply device. Because the gas chamber 13 at the leading end of the case body is filled with fuel gas and further because of sparkling with high-voltage sparks produced from the points of ignition copper wires, intensive sound and lighting effect of explosion will be created within the gas chamber.

When the two micromotion switches 24, 25 are pressed down by the bottom end of the target and the ignition device and gas supply device are actuated to create the effect of explosion, the bottom end of the target will be immediately pushed back by elastical follower plate on the two micromotion switches 24, 25 in order to cut off the two micromotion switches so as to terminate power supply and gas supply until the target being hit by another bullet to trigger it for creating next explosion effect.

As mentioned above, the fuel bottle 16 of the present invention is filled in non-oxygen fuel gas which is not spontaneous under the circumstance without oxygen and is free from back fire along with the conduit for causing an explosion. Certainly when in use the bottle 16 may be mounted with an explosive-proof connector 27 to avoid reversal attack by back fire in order to ensure safe. Besides, the amount of gas supply can be adjusted by means of a pressure valve 18 on the bottle 16 to accomplish various types and sizes of explosion effect.

Therefore, there has been shown and described a novel beacon target which fulfills all the objects and advantages sought therefore. Many changes, modifications, variations and other uses and applications of the subject invention will, however, become apparent to those skilled in the art after considering the foregoing specification together with the accompanying drawings. All such changes, modifications, variations and other uses and applications which do not depart from the spirit and scope of the invention are deemed to be covered by the invention which is limited only by claims which follow.

What is claimed is:

1. A beacon target for a shooting games, comprising air supply device received in a case body, and:

a case body having a first half portion which is separated as a gas chamber wherein the left and right ends of the gas chamber as well as the upper wall of the case body each having an air intake hole to permit air entry therefrom for mixing with fuel gas and causing flames to jet out of the case body at the moment of gas explosion, the leading end of the case body having a transparent panel for displaying gas explosion effect within the gas chamber, and the rear half portion of the case body for receiving each of said devices therein;

an air supply device in the case body, the air supply device having a fuel bottle which is in communication with a solenoid valve received in the case body by virtue of a conduit in connection with a pressure switch, and an air outlet end having a check valve extending through a baffle plate between the case body into the gas chamber, the fuel bottle is filled with non-oxygen fuel gas, when the solenoid valve is powered up, it controls the amount of fuel gas supplied from the fuel bottle into the gas chamber, when the power supply is cut-off from the solenoid valve the supply of fuel gas is synchronously cut off;

an ignition device in the case body, the ignition device having a battery connected to a micromotion switch within the case body by virtue of a cord and, the micromotion switch is connected to the solenoid switch, when the micromotion switch is triggered, it causes the solenoid valve to power up the conduit for feeding gas into the gas chamber; the ignition device also having another high-voltage power supply having a battery set mounted on the rear wall of the case body and controlled by a switch valve and connected to a transformer in the case by virtue of a cord through a micromotion switch and the output end of the transformer in connection with a plurality of ignition copper wires mounted on the baffle plate of the case body for actuating the high-voltage power ignition copper wires 26 and for sparking fuel gas within the gas chamber; and a movable target comprising a long plate shape at its top end having a target plane, the target plane having a bottom end inserted in the case body and located adjacent the two micromotion switches;

when the target plane at the upper end of the movable target is hit by a bullet, the bottom end of the target presses down on the two micormotion switches simultaneously actuating the ignition device and gas supply device, the fuel gas in the gas chamber and the high-voltage sparks produced from the points of ignition copper wires produce intensive sound and lighting effect of an explosion within the gas chamber.

* * * * *